US006354811B1

(12) United States Patent
Ota et al.

(10) Patent No.: US 6,354,811 B1
(45) Date of Patent: Mar. 12, 2002

(54) CONTROL VALVE FOR VARIABLE DISPLACEMENT COMPRESSORS

(75) Inventors: Masaki Ota; Masahiro Kawaguchi; Ken Suitou; Ryo Matsubara, all of Kariya; Kouji Watanabe, Fujisawa, all of (JP)

(73) Assignees: Kabushiki Kaisha Toyoda Jidoshokki Seisakusho, Kariya; NOK Corporation, Minato-Ku, both of (JP)

( * ) Notice: Subject to any disclaimer, the term of this patent is extended or adjusted under 35 U.S.C. 154(b) by 0 days.

(21) Appl. No.: 09/710,397

(22) Filed: Nov. 9, 2000

(30) Foreign Application Priority Data

Nov. 10, 1999 (JP) ..... 11-319466

(51) Int. Cl.[7] ..... F04B 1/32

(52) U.S. Cl. ..... 417/222.2; 137/596.17; 417/270

(58) Field of Search ..... 137/596.17; 417/222.2, 417/270

(56) References Cited

FOREIGN PATENT DOCUMENTS

| | | |
|---|---|---|
| EP | 0 985 823 A2 | 3/2000 |
| JP | 6-26454 | 2/1994 |
| JP | 2000-87849 | 3/2000 |

*Primary Examiner*—Gerald A. Michalsky
(74) *Attorney, Agent, or Firm*—Morgan & Finnegan, LLP

(57) ABSTRACT

A control valve controls the displacement of a variable displacement type compressor. The compressor includes a crank chamber, suction chamber, a bleed passage, and a supply passage. The control valve has a supply side valve, a transmission rod, and a relief side valve. The transmission rod connects the relief side valve with the supply side valve. The relief side valve includes a passage chamber constituting part of the bleed passage. The passage chamber is separated into a first area, which is connected to the crank chamber, and a lower area, which is connected to the suction chamber. A pressure sensing member moves the relief side valve body in accordance with the pressure in the upper area. The effective pressure receiving area of the sensing member is substantially equal to the cross sectional area of the passage chamber that is sealed by the relief side valve body.

16 Claims, 7 Drawing Sheets

CONTROL VALVE FOR VARIABLE DISPLACEMENT COMPRESSORS

BACKGROUND OF THE INVENTION

The present invention relates to a control valve for a variable displacement type compressor, and, more particularly, to a control valve for a variable displacement type compressor, which adjusts the displacement of the compressor in accordance with the pressure in a crank chamber.

Generally speaking, in a variable displacement type swash plate compressor for use in a vehicle air-conditioning system, the inclination angle of a swash plate, which is located in a crank chamber, is changed in accordance with the pressure in the crank chamber (crank pressure Pc). The crank chamber is connected to a suction chamber via a bleed passage. In the bleed passage is a displacement control valve, which performs feedback control of the displacement to keep the pressure in the vicinity of the outlet of an evaporator (suction pressure Ps), or the pressure of the refrigerant gas that is drawn in by the compressor (suction pressure Ps), at a target suction pressure even when the thermal load varies.

For example, Japanese Unexamined Patent Publication (KOKAI) No. Hei 6-26454 discloses a relief side control valve of a variable target suction pressure type compressor. The bleed passage connects the crank chamber of the compressor to a suction pressure area. Defined in the valve housing of the control valve is a valve chamber, which constitutes part of the bleed passage. Located in the valve chamber are a valve body and a bellows, which actuates the valve body in accordance with the suction pressure Ps. The degree of opening of the valve is adjusted in accordance with the expansion and constraction of the bellows. The control valve has a transmission rod and an electromagnetic actuator connected to the bellows via the valve body. The force of the electromagnetic actuator varies in accordance with the electric current supplied to the actuator. A target suction pressure Pset varies by controlling the magnitude of the electric urging force applied by the actuator.

FIG. 7 is a graph showing the relationship, which is simulated by a computer, between the suction pressure Ps and the crank pressure Pc when the displacement of the compressor is controlled by the aforementioned relief side control valve. Seven characteristic curves $\phi$1 to $\phi$7 indicate the characteristics of seven types of control valves, the conditions of which differ only in the aperture size of the valve hole. The characteristic curve $\phi$1 corresponds to the control valve that has the smallest aperture size, and the characteristic curve $\phi$7 corresponds to the control valve that has the largest aperture size. The aperture size increases as the number following $\phi$ increases. Each characteristic curve has a right portion rightward that extends from lower left to upper right. The asymptotic line of each curve is the diagonal line $\alpha$ of the graph (linear line of Pc=Ps). Each curve has left portion that extends from upper left to lower right and is continuous with the right portion, and a critical point (minimum point) occurs between the two portions of each curve.

The Pc/Ps gain is one index to evaluate the response characteristics of a control valve for a compressor. The Pc/Ps gain is scalar defined as the absolute value of the ratio of the amount of change $\Delta$Pc in the crank pressure Pc, which is a control output value, to the amount of change $\Delta$Ps in the suction pressure Ps, which is a control input value. In FIG. 7, the differential (dPc/dPs) of the left portion of each of the characteristic curves $\phi$1–$\phi$7, or the inclination of the associated tangential line, is equivalent to the Pc/Ps gain ($\Delta$Pc/$\Delta$Ps).

In general, the greater the gain is, the better the response characteristic of the control valve is. Therefore, a compressor that incorporates such a control valve can quickly and precisely respond to a change in the thermal load. The control valve that has a high gain causes the actual suction pressure Ps to quickly converge to near the target suction pressure Pset. The fluctuation of the actual suction pressure Ps is extremely small. In a control valve that has a small gain, by way of contrast, the actual suction pressure Ps does not converge to the target suction pressure Pset and significantly fluctuates up and down, which is commonly called hunting. Specifically, even if the actual suction pressure Ps is falling due to a decrease in the thermal load, for example, an increase in the crank pressure Pc is slow when the Pc/Ps gain is small. Therefore, the displacement does not fall rapidly, and the large-displacement continues. As a result, the actual suction pressure Ps continues falling and overshoots the target suction pressure Pset. The same is true of the case where the suction pressure Ps is increasing due to an increase in the thermal load. With a small Pc/Ps gain, hunting of the suction pressure Ps occurs, particularly when the rotational speed of the swash plate is relatively slow.

To increase the Pc/Ps gain, a difference $\Delta$Q of the flow rate of the gas that passes through the valve hole should be increased at the time the valve body moves in response to a change $\Delta$Ps in the suction pressure Ps. That is, the flow rate of the gas should be increased at once when the valve body is moved away from the valve seat. There are two ways to accomplish it as follows.

First, the amount of the displacement of the valve body with respect to a change $\Delta$Ps in the suction pressure Ps may be increased. In other words, a bellows that produces a large displacement in response to a slight change in the suction pressure Ps can be used. The large displacement of the valve body increases the difference $\Delta$Q of the flow rate of the gas. However, such a bellows is generally large. Further, the displacement control valve of a variable target suction pressure type compressor requires that the electromagnetic actuator be enlarged in accordance with an increase in the size of the bellows. This leads to a cost increase.

The second way is to enlarge the area of the aperture of the valve hole (the area to be sealed by the valve body). When the area of the aperture of the valve hole is large, the amount of gas that passes through the valve hole changes significantly even if the displacement of the valve body is slight with respect to a change $\Delta$Ps in the suction pressure Ps.

The larger the aperture of the valve hole is, however, the smaller the inclination of the left portion of the characteristic curve becomes as shown in FIG. 7. In other words, the Pc/Ps gain becomes smaller when the aperture increases. When the aperture of the valve hole is very small (e.g., as in the case $\phi$1), the characteristic curve has a steep left portion but the radius of the curve increases gentle in the vicinity of the minimum point, making the Pc/Ps gain smaller. To keep a stable and large Pc/Ps gain over a wide range, it is essential to select the characteristic curve $\phi$3 or $\phi$4 of the control valve.

The Pc/Ps gain is influenced by the force that act on the valve body, which is based on the differential pressure between the crank pressure Pc and suction pressure Ps. This force is expressed by (Pc−Ps)×S where S is the aperture area of the valve hole (i.e., S is the effective pressure receiving area of the valve body). The direction of the force is the direction in which the valve body is separated from the valve seat. The larger the aperture area S of the valve hole becomes, the more difficult it becomes for the valve body to be seated due to the force of the differential pressure. When the aperture area of the valve hole is large, therefore, the differential pressure (Pc−Ps) makes it hard for the control valve to be closed. This results in a slow increase in the crank pressure Pc so that the Pc/Ps gain drops.

SUMMARY OF THE INVENTION

Accordingly, it is an object of the present invention to provide a control valve for a variable displacement type compressor that can quickly change the crank pressure Pc.

To achieve the above object, the present invention provides a control valve. A control valve controls the displacement of a variable displacement type compressor. The compressor includes a crank chamber, a suction pressure zone, the pressure of which is suction pressure, a discharge pressure zone, the pressure of which is discharge pressure. A bleed passage releases gas from the crank chamber to the suction pressure zone. A supply passage supplies gas from the discharge pressure zone to the crank chamber. The control valve comprises a valve housing. A supply side valve controls the opening degree of the supply passage. A transmission rod extends in the valve housing. The transmission rod moves axially and has a distal end portion and a proximal end portion. A relief side valve control the opening degree of the bleed passage. The transmission rod connects the relief side valve with the supply valve. The relief side valve includes a passage chamber constituting part of the bleed passage. A valve seat defines part of the passage chamber. A relief side valve body contacts the valve seat. The relief side valve body is located in the passage chamber. When the relief side valve body contacts the valve seat, the passage chamber is separated into a first area, which is connected to the crank chamber via an upstream part of the bleed passage, and a second area, which is connected to the suction pressure zone via a downstream part of the bleed passage. A pressure sensing member is located in the first area and moving the relief side valve body in accordance with the pressure in the first area. When the relief side valve body contacts the valve seat, the effective pressure receiving area of the pressure sensing member is substantially equal to the cross sectional area of the passage chamber that is sealed by the relief side valve body.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

With reference to FIGS. 1 through 5, a description will be given of a first embodiment of the present invention as embodied in a displacement control valve for a clutchless variable displacement type swash plate compressor.

Figure 1:
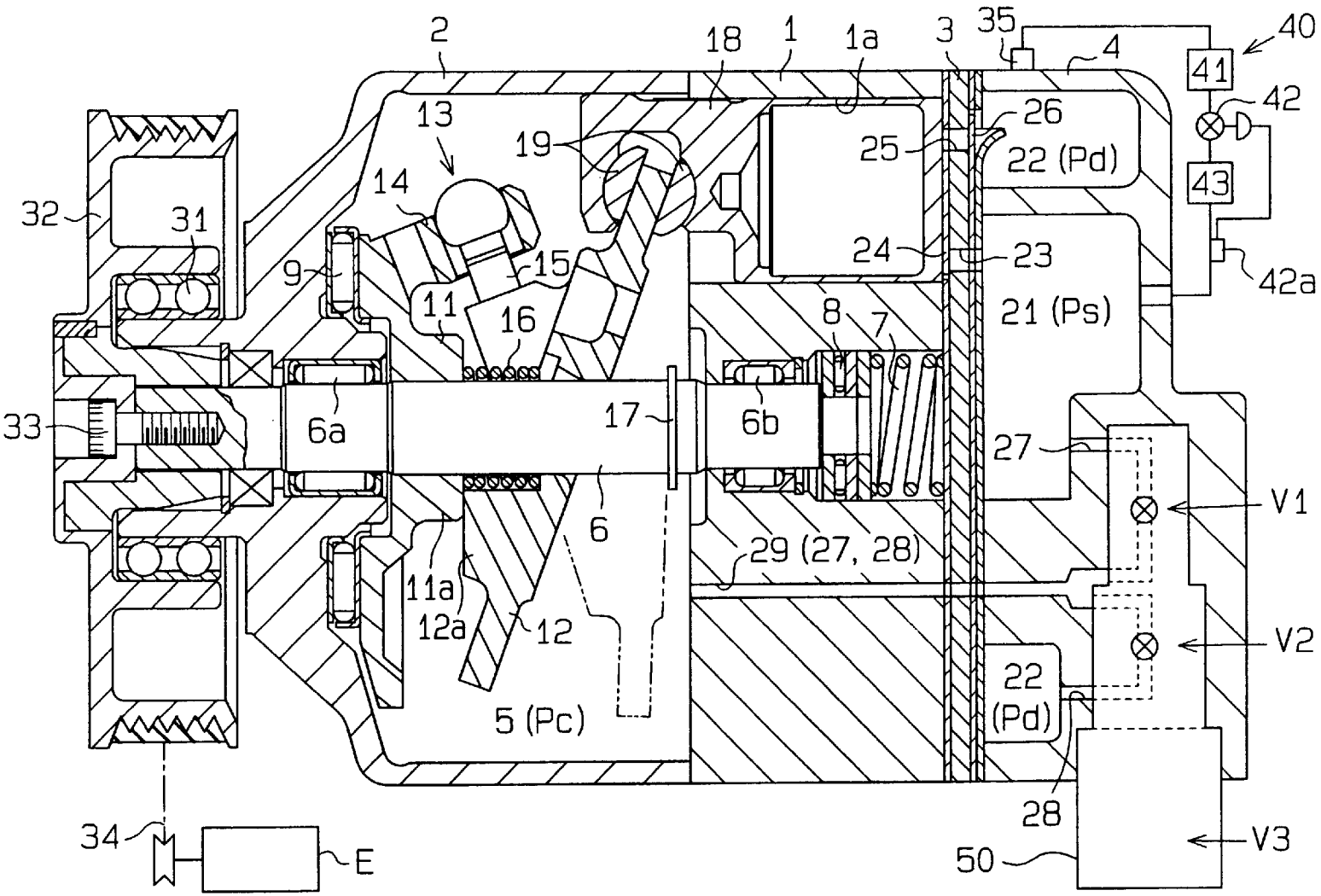
FIG. 1 is a cross-sectional view of a variable displacement type swash plate compressor according to a first embodiment of this invention.

As shown in FIG. 1, this swash plate compressor includes a cylinder block 1, a front housing 2 connected to the front end of the cylinder block 1, and a rear housing 4 connected via a valve plate 3 to the rear end of the cylinder block 1. The cylinder block 1, front housing 2, valve plate 3 and rear housing 4 are securely connected together by a plurality of bolts (not shown) to form a housing assembly. In FIG. 1, the left-hand side is the front side of the compressor and the right-hand side is the rear side.

A crank chamber 5 is defined in the area surrounded by the cylinder block 1 and the front housing 2. A drive shaft 6 is located in the crank chamber 5 and is supported on a plurality of radial bearings 6*a* and 6*b*, which are provided in the housing assembly. Located in a accommodation chamber formed nearly in the center of the cylinder block 1 are a coil spring 7 and a rear thrust bearing 8. A rotary support 11 is fixed to the drive shaft 6 to rotate together with the drive shaft 6. A front thrust bearing 9 is located between the rotary support 11 and the inner wall of the front housing 2. The drive shaft 6 is supported in the thrust direction by both the rear thrust bearing 8, which is urged forward by the coil spring 7, and the front thrust bearing 9.

A pulley 32 is supported on the front end portion of the front housing 2 by a bearing 31. The pulley 32 is secured to the front end of the drive shaft 6 by a bolt 33. The pulley 32 is connected to an engine E or an external drive source via a power transmission belt 34. While the engine E is running, the pulley 32 and the drive shaft 6 are rotated together.

A swash plate 12 is accommodated in the crank chamber 5. The drive shaft 6 is inserted in a hole that is bored through the center of the swash plate 12. The swash plate 12 is egaged with the rotary support 11 and the drive shaft 6 by a hinge mechanism 13. The hinge mechanism 13 includes support arms 14, each of which has a guide hole and protrude from the rear face of the rotary support 11, and guide pins 15, each of which has a spherical head and protrude from the front face of the swash plate 12. The linkage of the support arms 14 and the guide pins 15 causes the swash plate 12 to rotate synchronously with the rotary support 11 and the drive shaft 6. The swash plate 12 slides along the drive shaft 6 and inclines with respect to the drive shaft 6.

An inclination-angle reducing spring 16 (preferably a coil spring coiled around the drive shaft 6) is located between the rotary support 11 and the swash plate 12. The inclination-angle reducing spring 16 urges the swash plate 12 toward the cylinder block 1 (i.e., in a direction reducing the inclination angle of the swash plate 12). A restriction ring (preferably a circlip) 17 is attached to the drive shaft 6 behind the swash plate 12. The restriction ring 17 restricts the backward movement of the swash plate 12. The restriction ring 17 determines a minimum inclination angle θmin (e.g., 3 to 5°) of the swash plate 12. A maximum inclination angle θmax of the swash plate 12 is determined by a counter weight portion 12*a* of the swash plate 12, which abuts against a restriction portion 11*a* of the rotary support 11.

A plurality of cylinder bores 1*a* (only one shown) are formed in the cylinder block 1 at equal intervals around the axial center of the drive shaft 6. A single-head piston 18 is retained in each cylinder bore 1*a*. The front end of each piston 18 is connected to the peripheral portion of the swash plate 12 by a pair of shoes 19. Between the valve plate 3 and the rear housing 4 are a suction chamber 21 and a discharge chamber 22, which surrounds the suction chamber 21, as shown in FIG. 1. The valve plate 3 is provided with a suction port 23, a suction valve 24 for opening and closing the suction port 23, a discharge port 25 and a discharge valve 26 for opening and closing the discharge port 25 in association with each cylinder bore 1*a*. The suction chamber 21 is connected to the individual cylinder bores 1*a* by the suction ports 23, and the discharge chamber 22 is connected to the individual cylinder bores 1*a* by the discharge ports 25.

When the drive shaft 6 is rotated by the power supplied from the engine E, the swash plate 12, which is inclined at a predetermined angle θ, rotates accordingly. As a result, the individual pistons 18 reciprocate at the stroke corresponding to the inclination angle θ of the swash plate 12. This causes the sequence of suction of the refrigerant gas from the suction chamber 21 (at the suction pressure Ps), compression of the refrigerant gas and discharge of the refrigerant gas to the discharge chamber 22 (at the discharge pressure Pd) that is repeated in each cylinder bore 1*a*.

The inclination angle θ of the swash plate 12 is determined based on the balance of various moments, such as a rotational moment originated due to the centrifugal force generated when the swash plate 12 rotates, a moment due to the urging force of the inclination-angle reducing spring 16, a moment caused by the force of inertia based on the reciprocation of the piston 18, and a moment due to the gas pressure. The gas-pressure moment is generated based on the relationship between the inner pressure of the cylinder bore 1*a* and the crank pressure Pc. In this embodiment, the gas-pressure moment is changed by adjusting the crank pressure Pc with a displacement control valve 50 (discussed later). The inclination angle θ of the swash plate 12 is changed to an arbitrary angle between the minimum inclination angle θmin and the maximum inclination angle θmax in accordance with the adjustment of the crank pressure Pc. The inclination angle θ of the swash plate 12 is the angle defined by the swash plate 12 and an imaginary plane perpendicular to the drive shaft 6. The maximum inclination angle θmax of the swash plate 12 occurs when the counter weight 12*a* of the swash plate 12 abuts against a restriction portion 11*a* of the rotary support 11. As the inclination angle of the swash plate 12 is changed in accordance with the crank pressure Pc, the stroke of each piston 18 and the displacement of the compressor are variably adjusted.

Figure 2:
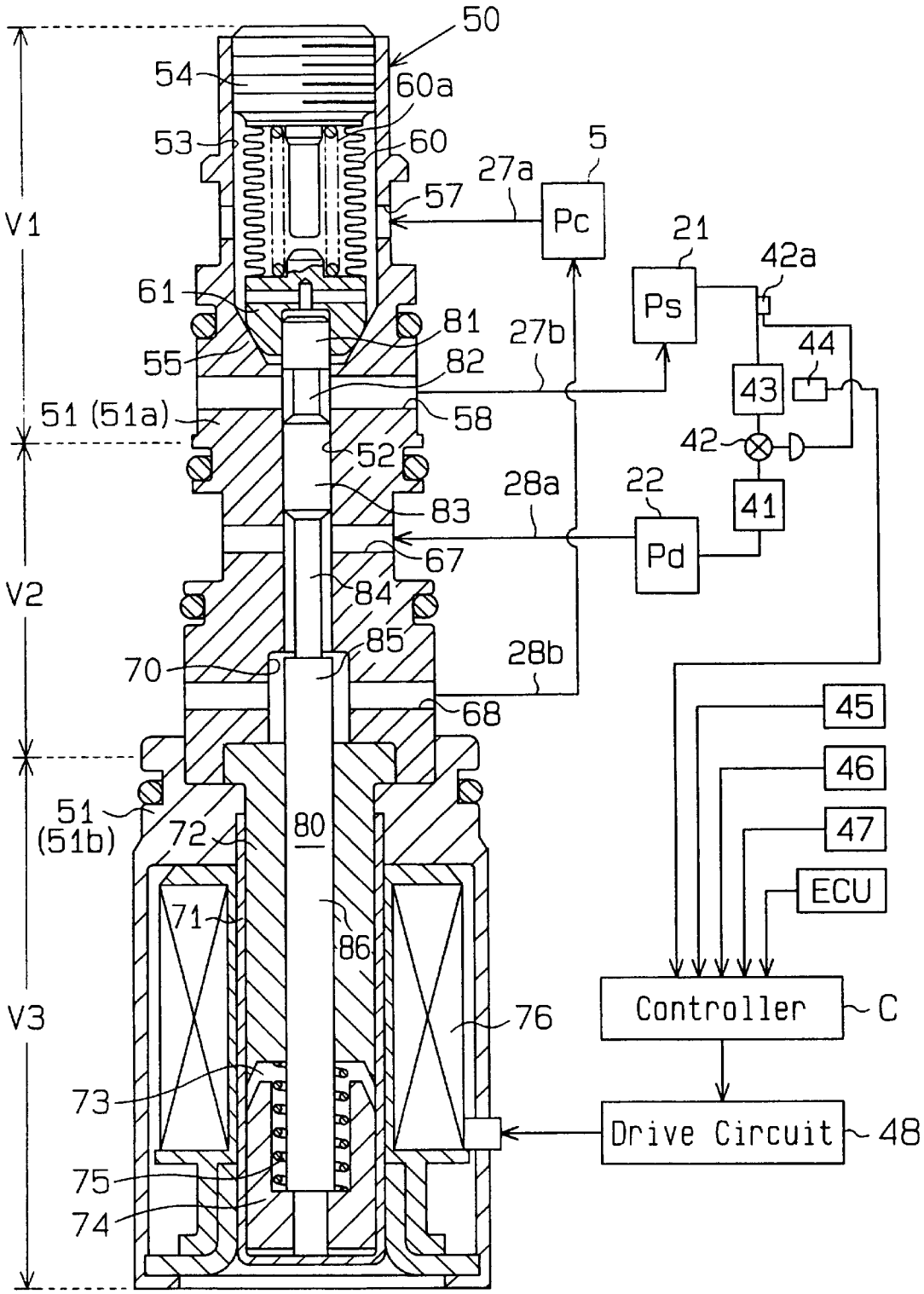
FIG. 2 is a cross-sectional view of a displacement control valve of the compressor in FIG. 1.

The control mechanism that controls the crank pressure Pc includes a bleed passage 27, a supply passage 28 and the displacement control valve 50, which are accommodated in the housing of the compressor as shown in FIGS. 1 and 2. The bleed passage 27 connects the suction chamber 21 to the crank chamber 5, and the supply passage 28 connects the discharge chamber 22 to the crank chamber 5. The bleed passage 27 and the supply passage 28 share a common passage 29 between the control valve 50 and the crank chamber 5. The displacement control valve 50 has a relief side valve V1, located midway in the bleed passage 27, and an supply side valve V2 located midway in the supply passage 28.

The suction chamber 21 and the discharge chamber 22 are connected by an external refrigeration circuit 40. The external refrigeration circuit 40 and the compressor constitute the cooling circuit of the vehicle air-conditioning system. The external refrigeration circuit 40 includes a condenser 41, an expansion valve 42 and an evaporator 43. The opening size of the expansion valve 42 is feedback controlled based on the temperature detected by a temperature sensing cylinder 42*a* at the outlet side of the evaporator 43. The expansion valve 42 provides the evaporator 43 with an amount of refrigerant gas that matches the thermal load, thus regulating the flow rate of the refrigerant gas.

As shown in FIG. 1, a check valve mechanism 35 is located between the discharge chamber 22 and the condenser 41. The check valve mechanism 35 inhibits the counter flow of refrigerant from the condenser 41 to the discharge chamber 22. When the discharge pressure Pd is relatively low, the check valve mechanism 35 is closed such that the refrigerant gas circulates inside the compressor.

As shown in FIG. 2, a temperature sensor 44 is provided near the evaporator 43. The temperature sensor 44 detects the temperature of the evaporator 43 and provides a controller C with the information of the detected temperature. The controller C performs the entire control procedure of the vehicle air-conditioning system. Connected to the input side of the controller C are the temperature sensor 44 and a passenger compartment temperature sensor 45 for detecting the temperature inside the vehicle, a temperature setting unit 46 for setting the compartment temperature, an activation switch 47 and an electronic control unit (ECU) for the engine E. The output side of the controller C is connected to a drive circuit 48, which supplies an electric current to a solenoid V3 of the control valve 50. The controller C instructs the drive circuit 48 to feed the appropriate current to the solenoid V3 based on external information, such as the temperature from the temperature sensor 44, the temperature sensed by the passenger compartment temperature sensor 45, the target temperature set by the temperature setting unit 46, the ON/OFF state of the activation switch 47, the activation or deactivation of the engine E and the engine speed, the last two pieces of information being given by the ECU. The controller C externally controls the degree of opening of the supply side valve V2 and a target suction pressure Pset at the relief side valve V1.

As shown in FIG. 2, the displacement control valve 50 includes the relief side valve V1, the supply side valve V2 and the solenoid V3. The relief side valve V1 can adjust the degree of opening (the amount of restriction) of the bleed passage 27. The supply side valve V2 controls the degree of opening of the supply passage 28. The solenoid V3 is an electromagnetic actuator that controls an actuation rod 80 of the control valve 50 based on an externally supplied current. While one of the relief side valve V1 and the supply-side valve V2 is substantially closed via the actuation rod 80, which is controlled by the solenoid portion V3, the other is opened. The control valve 50 which has those relief side valve V1 and supply side valve V2, is a three-way control valve.

The displacement control valve 50 has a valve housing 51, which has an upper portion 51*a* and a lower portion 51*b*. The upper portion 51*a* constitutes the relief side valve V1 and the supply side valve V2. The lower portion 51*b* includes the solenoid V3. Formed in the center of the upper portion 51*a* of the valve housing 51 is a guide passage 52, which extends in the axial direction of the upper half portion 51*a*. The actuation rod 80 is retained in the guide passage 52 and is movable in the axial direction.

As shown in FIGS. 2 to 5, the actuation rod 80 has a distal portion 81, a first link portion 82, an intermediate portion 83, a second link portion 84, a valve body 85, which serves as the supply side valve body, and a third link portion (or proximal portion) 86. The cross sections of the individual portions 81–86 are circular. The distal portion 81, the intermediate portion 83, the valve body 85 and the third link portion 86 have the same outside diameter d1 and the same cross-sectional area S1. The first link portion 82, which links the distal portion 81 and the intermediate portion 83, and the second link portion 84, which links the intermediate portion 83 and the valve body 85, have an outside diameter d2 (which is smaller than the outside diameter d1) and a cross-sectional area S2. The outside diameter of the valve body 85 can be slightly smaller than d1 (by Δd1). That is, the outside diameter of the valve body 85 ranges from d1 to d1–Δd1.

The guide passage 52 extends in the axial direction of the actuation rod 80. The first link portion 82, the intermediate portion 83, the second link portion 84 and the valve body 85 are retained in the guide passage 52. The inside diameter of the guide passage 52 is nearly equal to the outside diameter d1 of the intermediate portion 83. When the intermediate portion 83 is fitted in the guide passage 52, the guide passage 52 is separated into an upper area on the relief-side valve V1 side and a lower area on the supply-side valve V2 side. The intermediate portion 83 separates the two areas from each other in terms of pressure, not to connect the two areas through the intermediate portion 83.

Figure 3:
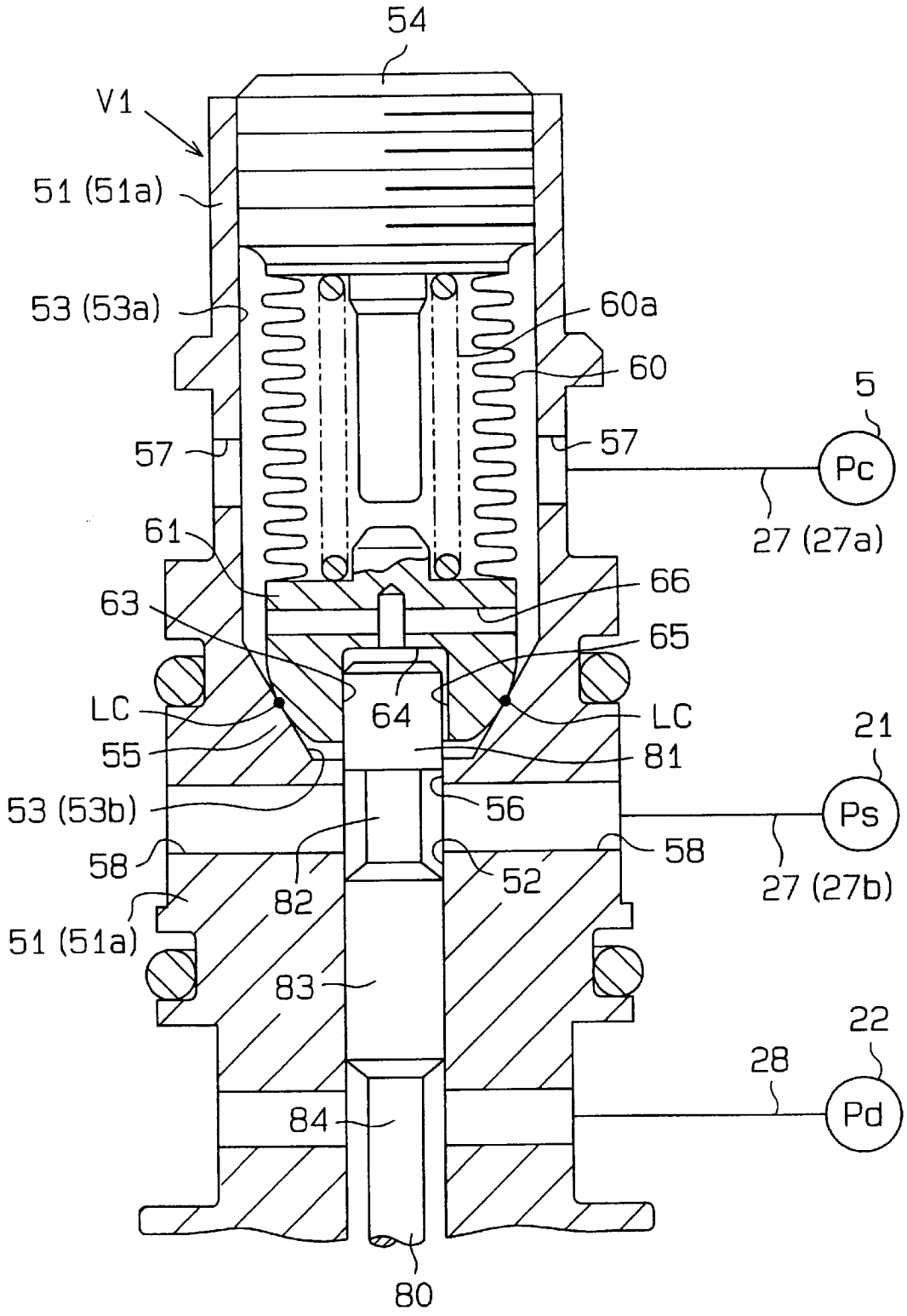
FIG. 3 is a partly enlarged cross-sectional view of a portion around the relief side valve portion of the control valve in FIG. 2.

FIG. 3 is an enlargement of the relief-side valve V1 in FIG. 2. An adjusting member 54 is threaded into the upper portion of the upper portion 51*a*. A relief-side valve chamber 53, which also serves as a pressure sensitive chamber, is defined in the upper portion 51*a*. A relief-side valve body 61 is provided in the valve chamber 53. The relief-side valve body 61 is seated on a conical valve seat 55 at the lower portion of the valve chamber 53. As shown in FIG. 3, an annular contact area LC is formed where the valve body 61 is seated on the valve seat 55. The valve chamber 53 can be separated into an upper area (crank-chamber side area) 53*a* and a lower area (suction-chamber side area) 53*b* with the annular contact area LC as a boundary.

Figure 4:
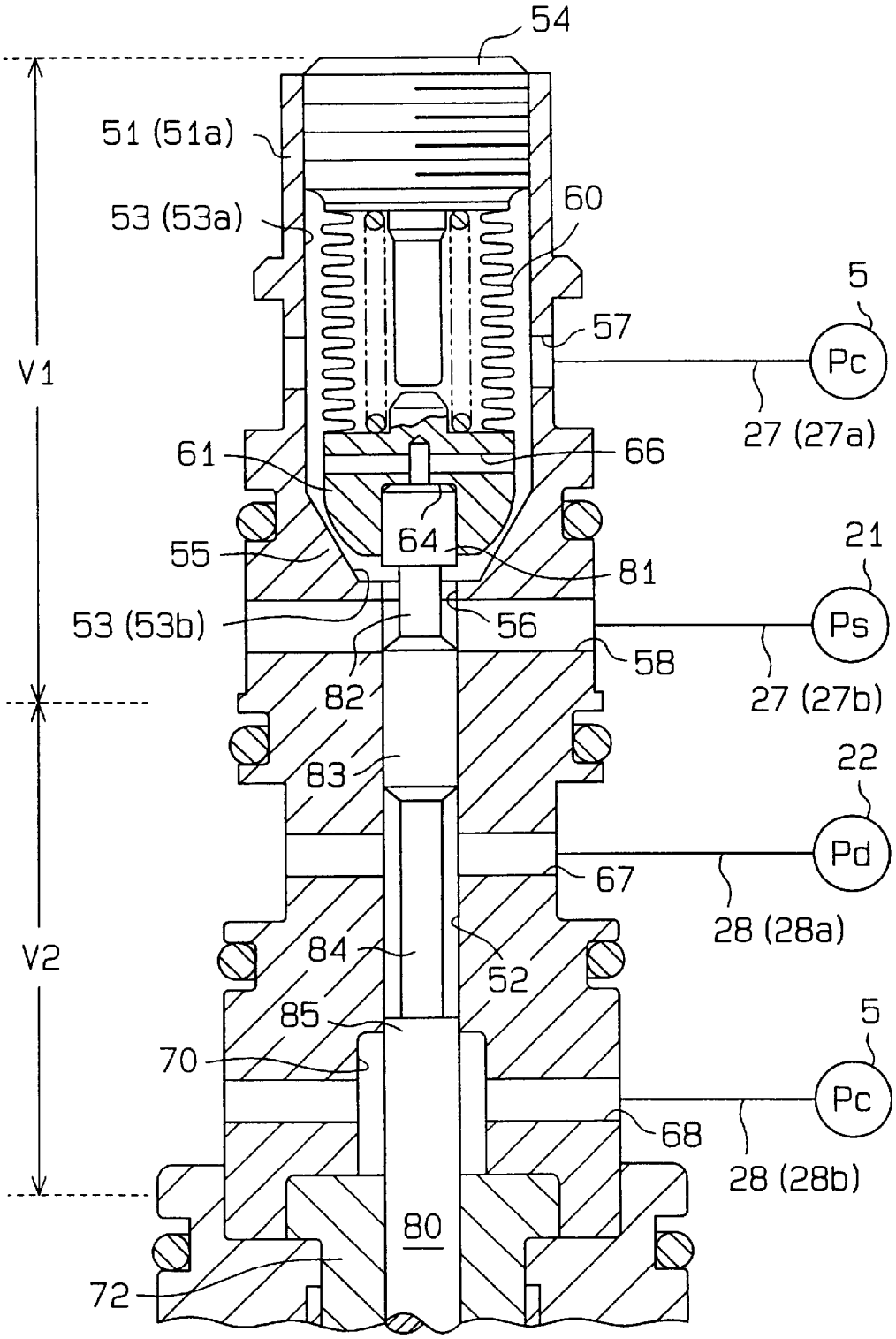
FIG. 4 is an enlarged cross-sectional view showing the relief side valve portion and supply side valve portion of the control valve in FIG. 2.

As shown in FIGS. 3 and 4, an intermediate port 56, which connects the lower area 53*b* to the upper part of the guide passage 52 is formed in the center of the bottom of the valve chamber 53. The inside diameter of the intermediate port 56 is slightly larger than the outside diameter d1 of the distal portion 81 (the inside diameter of the guide passage 52). Therefore, the distal portion 81 of the actuation rod 80 can move into and out of the intermediate port 56. When the distal portion 81 enters the intermediate port 56, as shown in FIG. 3, a slight clearance Δd2 is formed between them. Since the slight clearance 66 d2 is very small, it is not shown in the diagram. The slight clearance Δd2 serves as a restrictor.

As shown in FIGS. 2 and 3, a plurality of supply ports 57 are provided in the upper portion 51*a*. The valve chamber 53 is connected to the crank chamber 5 by the individual supply ports 57 and the upstream portion 27*a* of the bleed passage 27. The upstream portion 27*a* of the bleed passage 27 and the supply ports 57 serve as a part of a pressure-detecting passage for applying the crank pressure Pc to the upper area 53*a*. Between the guide passage 52 and the intermediate port 56 are a plurality of outlet ports 58, which extend in the radial direction. The suction chamber 21 is connected to the upper area of the guide passage 52 and the intermediate port 56 by the individual outlet ports 58 and the downstream portion of the bleed passage 27*b*. When the intermediate port 56 is opened, as shown in FIG. 4, the suction pressure Ps is applied to the lower area 53*b* of the valve chamber 53. The supply ports 57, the valve chamber 53, the intermediate port 56, a part of the guide passage 52 and the outlet ports 58 constitute a part of the bleed passage 27 that connects the crank chamber 5 to the suction chamber 21 in the relief-side valve V1.

As shown in FIG. 3, a bellows 60 is provided in the upper area 53*a* to serve as a pressure sensitive member that moves in response to the crank pressure Pc. One end of the bellows 60 is secured to an adjusting member 54, and the other end is movable. The inner space of the bellows 60 is set to a vacuum state or a depressurized state. A set spring 60*a* is located in the bellows 60. With the adjusting member 54 as a support seat, the set spring 60*a* urges the valve body 61 toward the seat 55. The movable end of the bellows 60 is integrated with the relief-side valve body 61. The relief-side valve body 61, when seated on the valve seat 55, shuts the bleed passage 27.

As shown in FIG. 3, the relief-side valve body 61 has a recess 63, which is open toward the intermediate port 56. The distal portion 81 of the actuation rod 80 is fitted in the recess 63 in a relatively loose manner. The recess 63 has an end surface 64, which faces the end of the distal portion 81, and an inner wall 65, which faces the circumferential surface of the distal portion 81. The end surface 64 contacts the end face of the distal portion 81 when the disital portion 81 is located in its upper portion. The inner wall 65 of the recess 63 partially contacts and guides the outer surface of the distal portion 81. The inside diameter of the recess 63 is slightly larger than the outside diameter d1 of the distal end portion 81 (by Δd3), i.e., the inside diameter is d1+Δd3. In other words, a clearance (Δd3) is formed between the outer surface of the distal end portion 81 and the inner wall 65 of the recess 63. The clearance Δd3 is larger than the clearance Δd2 that is formed between the distal portion 81 and the wall of the intermediate port 56 (Δd2<Δd3).

An inner passage 66 is formed in the relief-side valve body 61. The inner passage 66 is formed through the valve body 61 in the diametrical direction and extends axially in the center of the valve body 61 to communicate with the recess 63. The inner passage 66 connects the upper area 53*a* to the interior of the recess 63. When the end surface 64 contacts with the end face of the distal portion 81, communication between the upper area 53*a* and the interior of the recess 63 is blocked. That is, when seated on the valve seat 55, the relief-side valve body 61 blocks communication between the upper area 53*a* and the lower area 53*b* through the clearance between the valve body 61 and the valve seat 55. However, communication between the upper area 53*a* and the lower area 53*b* of the valve chamber 53 continues through the path in the valve body 61 (i.e., the inner passage 66 and the path along the end surface 64 and the inner wall 65 of the recess 63) unless the distal portion 81 of the actuation rod 80 closes the central opening of the inner passage 66. That is, there are two branches of the bleed passage 27 that extend between the upper area 53*a* and the lower area 53*b*, and they are selectively opened.

As shown in FIGS. 2 and 4, in the supply-side valve V2, the lower area of the guide passage 52 and an supply-side valve chamber 70 are defined in the upper portion 51*a*. The supply-side valve chamber 70 is connected to the guide passage 52. The inside diameter of the supply-side valve chamber 70 is larger than the inside diameter d1 of the guide passage 52. The bottom wall of the supply-side valve chamber 70 is provided by the upper end face of a fixed iron core 72. A plurality of supply ports 67, which extend in the radial direction, are provided in the valve housing at the lower part of the guide passage 52. The guide passage 52 communicates with the discharge chamber 22 through the individual supply ports 67 and the upstream portion of the supply passage 28*a*. A plurality of outlet ports 68, which extend in the radial direction, are provided in the valve housing at the supply-side valve chamber 70. The individual outlet ports 68 connect the supply-side valve chamber 70 to the crank chamber 5 through the downstream portion of the supply passage 28*b*. That is, the supply ports 67, the lower area of the guide passage 52, the supply-side valve chamber 70 and the outlet ports 68 constitute a part of the supply passage 28 that communicates the discharge chamber 22 and the crank chamber 5 in the supply valve V2. The crank pressure Pc acts on the supply-side valve chamber 70 through the outlet ports 68.

As shown in FIG. 2, the valve body 85 of the actuation rod 80 is located in the supply-side valve chamber 70. When the actuation rod 80 moves to the position shown in FIG. 4 from the state shown in FIG. 2, the valve body 85 enters the guide passage 52 and closes the passage 52. The valve body 85 of the actuation rod 80 serves as an supply-side valve body that selectively opens or closes the guide passage 52 and to thus to open or close (or to open and substantially close) the supply passage 28. In the supply-side valve V2, the guide passage 52 serves as a valve hole that is closed by the valve body 85.

When the outside diameter of the valve body 85 is substantially equal to the inside diameter of the guide passage 52, the supply-side valve V2 fully closes. When the outside diameter of the valve body 85 is slightly smaller than the inside diameter of the guide passage 52 (i.e., d1–Δd1), the valve body 85 does not fully close the guide passage 52 even if the valve body 85 enters the guide passage 52 as shown in FIG. 4. When the valve body 85 enters the guide passage 52, however, the cross-sectional area of the resulting passage is significantly small so that the supply-side valve V2 is substantially closed. When the valve body 85 enters the guide passage 52, a restriction defined by the difference Δd1 between the inside diameter of the guide passage 52 and the outside diameter of the valve body 85 is formed in the air-supply passage 28. This restriction serves as an auxiliary supply passage to supplement the blowby gas. The blowby gas is refrigerant gas that leaks into the crank chamber 5 from around the piston 18 as the piston 18 performs the compression stroke. Since the supply of the blowby gas is generally unstable, it is preferred that the supply-side valve portion V2 serve as an auxiliary supply passage to supplement the blowby gas when the relief-side valve V1 is active (i.e., when the supply-side valve V2 is substantially closed).

As shown in FIG. 2, the solenoid V3 has a cylindrical retainer cylinder 71 with a bottom. The fixed iron core 72 is fitted in the upper portion of the retainer cylinder 71. A solenoid chamber 73 is defined in the retainer cylinder 71. A movable iron core 74, or a plunger, is retained in the solenoid chamber 73 in an axially movable manner. The third link portion 86 of the actuation rod 80 is located at the center of the fixed iron core 72 and is movable in the axial direction. The upper end of the third link portion 86 is the valve body 85. The lower end of the third link portion 86 is fitted into a through hole formed in the center of the movable iron core 74 and is secured in the through hole by crimping. Therefore, the movable iron core 74 and the actuation rod 80 move together. There is a slight clearance (not shown) between the inner wall of a rod guide passage formed in the center of the fixed iron core 72 and the outer surface of the third link portion 86 of the actuation rod 80. The supply-side valve chamber 70 is connected to the solenoid chamber 73 by this clearance. According to this embodiment, therefore, the crank pressure Pc also acts on the solenoid chamber 73.

A return spring 75 is located between the fixed iron core 72 and the movable iron core 74. The return spring 75 acts to urge the movable iron core 74 away from the fixed iron core 72, which is downward in FIG. 2. The return spring 75 therefore initially positions the movable iron core 74 and the actuation rod 80 to the lowest movable position (the initial position at the time of deenergization) shown in FIG. 2.

A coil 76 is wound around the fixed iron core 72 and the movable iron core 74 to surround both cores 72 and 74. The drive circuit 48 supplies a predetermined current to the coil 76 in response to an instruction from the controller C. The coil 76 generates the electromagnetic force, the magnitude of which corresponds to the level I of the supplied current. The electromagnetic force causes the movable iron core 74 to be attracted toward the fixed iron core 72, which moves the actuation rod 80 upward. When no current is supplied to the coil 76, the urging force of the return spring 75 places the actuation rod 80 at the lowest movable position (initial position) shown in FIG. 2. Then, the distal portion 81 of the actuation rod 80 moves away from the end surface 64, and the valve body 85 is separated from the lower end of the guide passage 52, as shown in FIGS. 2 and 3. That is, the relief-side valve body 61 is seated on the valve seat 55, closing the relief-side valve V1 and opening the supply-side valve portion V2.

When the current is supplied to the coil 76, the upward electromagnetic force generated by the current supply becomes greater than the downward force of the return spring 75. As a result, the valve body 85 moves into the guide passage 52 and the end face of the distal portion 81 contacts the end surface 64, which closes the supply-side valve V2. Accordingly, the bellows 60 (including the spring 60*a*), the relief-side valve body 61, the actuation rod 80 and the solenoid V3 are operating coupled together. Based on the dynamic relationship between the coupled members, the position of the relief-side valve body 61 in the relief-side valve chamber 53 (the distance between the valve body 61 and the valve seat 55) is determined. The degree of opening of the relief-side valve V1 is determined accordingly. That is, the electromagnetic force, which is adjusted by the solenoid V3, changes the target suction pressure Pset of the relief-side valve V1 against the opposing force of the entire pressure sensitive mechanism (60, 60*a*). In other words, when the current is supplied to the coil 76, the relief-side valve V1 serves as a variable setting type relief-side control valve that can change the target suction pressure Pset based on the value of the externally supplied current.

Figure 5:
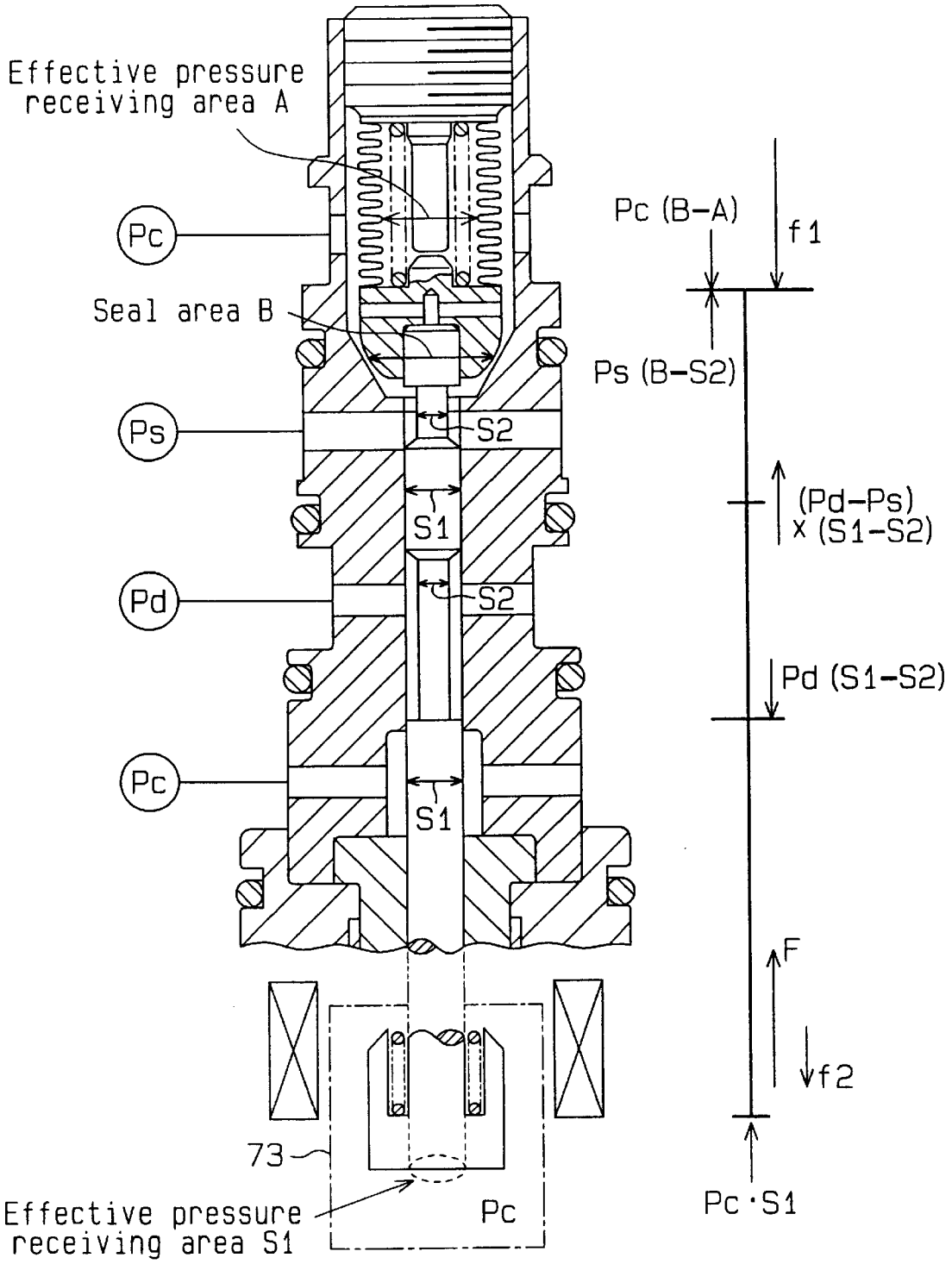
FIG. 5 is a force diagram including the dimensions of the main portions of the control valve along side of a diagram of the valve of FIG. 4.

FIG. 5 shows the situation when the current supply to the coil 76 couples the relief-side valve body 61 and the actuation rod 80 together and when the control valve 50 serves mainly as a relief-side control valve.

FIG. 5 shows a downward force f1, which is generated by the bellows 60 and the set spring 60*a*, a downward force f2 of the return spring 75 and an upward electromagnetic force of the actuation rod 80. FIG. 5 further shows an effective area A of the bellows 60 and a substantial seal area B formed by the relief-side valve body 61 when the valve body 61 is seated. As far as the crank pressure Pc that acts on the top and bottom surfaces of the movable iron core 74 is concerned, the effective pressure receiving area of the lower end portion of the actuation rod 80 in the solenoid chamber 73 can be regarded as the cross-sectional area S1 of the third link portion (proximal end portion) 86 of the actuation rod 80.

The following considers the pressure that acts on the relief-side valve body 61, the intermediate portion 83, the valve body 85 and the lower end portion of the actuation rod 80. First, the mechanical urging force f1 produced by the bellows 60 acts on the relief-side valve body 61. Since the movable end of the bellows 60 is secured to the valve body 61, the effective pressure receiving area of the relief-side valve body 61 in association with the crank pressure Pc is obtained by subtracting the effective area A of the bellows 60 from the seal area B. Therefore, the force due to the crank pressure Pc(B−A) in the direction of closing the guide passage 52 and the force due to the suction-pressure Ps(B−S2) in the direction of opening the guide passage 52 act on the relief-side valve body 61. A force (Pd−Ps)×(S1−S2) that pushes the actuation rod 80 based on the differential pressure between the discharge pressure Pd and the suction pressure Ps acts on the intermediate portion 83. A force Pd(S1−S2) that urges the actuation rod 80 downward based on the discharge pressure Pd acts on the valve body 85. A force PcS1, which urges the actuation rod 8 upward and which is based on the cross-sectional area S1 in the solenoid chamber 73 and the crank pressure Pc, acts on the lower end portion of the actuation rod 80. Further, the upward electromagnetic force F, from which the force f2 is subtracted, acts on the actuation rod 80. Based on the balance of the various forces, the position of the actuation rod 80 (or the degree of opening of the relief-side valve V1) is determined. With the downward direction is viewed as the positive direction, the forces that act on the individual members have the relationship represented in a first equation below:

$$f1+Pc(B-A)-Ps(B-S2)-(Pd-Ps)(S1-S2)+Pd(S1-S2)-Pc\cdot S1-F+f2=0$$

Rearranging the equation 1 yields an equation 2 below:

$$Pc(B-A-S1)-Ps(B-S1)=F-f1-f2$$

In the process of rearranging the first equation to yield the second equation, S2 and Pd are canceled from the second equation. Thus the influence of the suction pressure Ps that acts on the first link portion 82 on the actuation rod 80 does not depend on the cross-sectional area S2 of the first link portion 82. The canceling of S2 and Pd also indicates that the influence of the discharge pressure Pd that acts on the second link portion 84 on the actuation rod 80 is always canceled regardless of the cross-sectional area S1 and the cross-sectional area S2 of the second link portion 84.

If the effective area A of the bellows 60, the seal area B formed by the valve body 61 and the effective pressure receiving area S1 of the lower end portion of the actuation rod 80 are set to satisfy the condition of A≈B and S1<B (most preferably A+S1=B), the term Pc(B−A−S1) in the second equation becomes zero or small enough to be negligible. Therefore, the following third equation is derived from the second equation.

$$Ps\approx(f1+f2-F)/(B-S1)$$

$$Ps=(f1+f2-F)/A$$

$$(A+S1\neq B)$$

$$(A+S1=B)$$

In the third equation, f1, f2, A, B and S1 are constants because they could be determined in advance in designing steps. The electromagnetic force F is changed in accordance with the value I of the current supplied to the coil 76. The suction pressure Ps is specifically determined only by those parameters and does not depend on the crank pressure Pc at all. That is, the target suction pressure Pset when the control valve 50 serves as the relief-side control valve can be set variably in accordance with the value I of the current supplied to the coil 76. In other words, the control valve 50 serves as a variable target suction pressure type control valve that performs control based on the externally supplied current. When the current supply to the coil 76 is stopped (i.e., F=0), the value of the target suction pressure Pset becomes maximum. As the value I of the current supplied to the coil 76 increases, the value of the target suction pressure Pset decreases. Therefore, the solenoid V3 and the controller C externally change the target suction pressure Pset.

Controlling the variable displacement type compressor will now be discussed.

With the engine E stopped, no current is supplied to the coil 76. At this time, the relief-side valve body 61 and the actuation rod 80 are uncoupled as shown in FIGS. 2 and 3. Therefore, the relief-side valve body 61 is seated mainly by the downward force f1 by the bellows 60, thus closing the relief-side valve V1. The downward force f2 of the return spring 75 moves the actuation rod 80 to the lowest position (initial position) as shown in FIG. 2, thus opening the supply-side valve V2. When the deactivation of the compressor continues over a long period of time, the pressures in the individual chambers 5, 21 and 22 equalize. As a result, the swash plate 12 is held at the minimum inclination angle by the force of the inclination-angle reducing spring 16.

When the engine E runs, the clutchless compressor starts operating. With the activation switch 47 of the air-conditioning system set off, no current is supplied to the coil 76 and the inclination angle of the swash plate 12 is minimum, thus minimizing the displacement of the compressor. During a predetermined time from the activation of the engine E, the discharge pressure Pd in the discharge chamber 22 does not become high enough to push the check valve mechanism 35 open. Therefore, the refrigerant gas in the discharge chamber 22 flows into the crank chamber 5 via the upstream portion 28*a* of the supply passage 28, the supply-side valve V2 and the downstream portion 28*b* of the supply passage 28. The gas that has entered the crank chamber 5 flows out to the suction chamber 21 through the upstream portion 27*a* of the bleed passage 27, the relief-side valve V1 and the downstream portion 27*b* of the bleed passage 27.

When no current is supplied to the coil 76, the force f1 of the bellows 60 causes the relief-side valve body 61 to contact the valve seat 55, thus closing the bleed passage 27 between the valve body 61 and the valve seat 55 as shown in FIG. 3. At this time, the distal portion 81 of the actuation rod 80 is separated from the end surface 64 of the recess 63. Consequently, a communication passage extending from the inner passage 66 of the valve body 61 through the clearance Δd3 along the end surface 64 and the inner wall 65 is formed between the upper area 53*a* and the lower area 53*b*. The distal portion 81 enters the intermediate port 56, forming the clearance Δd2, through which the lower area 53*b* is connected to the outlet ports 58. That is, when no current is supplied to the coil 76 (when the relief-side valve V1 does not perform automatic opening adjustment), at least a new flow path extending through the clearance Δd2 from the inner passage 66 is formed. When the activation switch 47 is off, therefore, a circulation passage, which circulates the refrigerant gas back to the suction chamber 21 through the route of the suction chamber 21, the cylinder bore 1*a*, the discharge chamber 22, the upstream portion 28*a* of the supply passage 28, the opened supply-side valve V2, the downstream portion 28*b* of the supply passage 28, the crank chamber 5, the upstream portion 27*a* of the bleed passage 27, the relief-side valve V1 (through the clearance of the inner passage 66), and the downstream portion 27*b* of the bleed passage 27 is formed in the compressor even when the compressor is always operated with the minimum discharge capacity.

The clearance Δd2 is smaller than the clearance Δd3, and the communication passage extending from the inner passage 66 through the clearance Δd2 serves as a fixed-restriction passage. The flow rate of the refrigerant gas flowing in the circulation passage is restricted by the clearance Δd2. When the crank pressure Pc increases and the valve body 61 moves upward suddenly, therefore, the distal portion 81 is held in the intermediate port 56 and the clearance Δd2 serves as a fixed restriction unless the current is supplied to the coil 76.

Lubrication oil is supplied to the crank chamber 5 for lubrication of the sliding parts. To always feed lubrication oil to the sliding parts, the lubrication oil should be carried in the form of a mist by using the flow of the gas. When gas does not flow in the compressor, therefore, the oil drops off the sliding portions, resulting in insufficient lubrication. This shortcoming does not however occur in the compressor of this embodiment.

When the activation switch 47 is on while the engine E is running, the controller C instructs that current be supplied the coil 76. Then, the electromagnetic force of the coil 76 causes the actuation rod 80 to move upward against the downward force f2 of the return spring 75, thus closing the supply-side valve V2. Then, the degree of opening of the relief-side valve V1 is adjusted with the relief-side valve V1, which is coupled to the solenoid V3 as shown in FIG. 4. The degree of opening of the relief-side valve V1 (i.e., the position of the relief-side valve body 61 in the valve chamber 53) is determined by the balance of the various parameters given in equation 3. The relief-side valve V1 serves as an internal control valve, which performs automatic opening adjustment in accordance with the suction pressure Ps.

When the cooling load becomes large, the pressure in the vicinity of the outlet of the evaporator 43 (the suction pressure Ps) increases gradually, and the difference between the temperature detected by, for example, the room temperature sensor 45 and the temperature set by the room temperature setting unit 46 increases. Since the discharge performance of the compressor must match the cooling load, the controller C controls the value of the current supplied to the coil 76 to change the target suction pressure Pset based on the detected temperature and the set temperature. Specifically, as the detected temperature gets higher, the controller C increases the value of the supplied current supplied to increase the electromagnetic force F. Thus the target suction pressure Pset of the control valve 50 is set to a relatively low level. To make the target suction pressure Pset lower than the actual suction pressure Ps, therefore, the opening size of the relief-side valve V1 increases. This increases the flow rate of the refrigerant gas that relieved from the crank chamber 5. As the supply-side valve V2 is closed, the flow of gas out of the crank chamber 5 reduces the crank pressure Pc. Under a large cooling load, the pressure of the gas to be fed into the cylinder bore 1*a*, or the suction pressure Ps, is relatively high, making the difference between the pressure in the cylinder bore 1*a* and the crank pressure Pc relatively small. This increases the inclination angle of the swash plate 12, thus increasing the displacement of the compressor.

When the cooling load decreases, the pressure in the vicinity of the outlet of the evaporator 43 (the suction pressure Ps) decreases gradually, and the difference between the temperature detected by, for example, the room temperature sensor 45 and the temperature set by the room temperature setting unit 46 decreases. To match the discharge performance of the compressor to the cooling load, the controller C controls the value of the current supplied to the coil 76 to change the target suction pressure Pset. Specifically, as the detected temperature decreases, the controller C decreases the value of the supplied current to the coil 76, thereby reducing the electromagnetic force F. This causes the target suction pressure Pset to be relatively high. To change the suction pressure Ps to the target suction pressure Pset, the opening size of the relief-side valve V1 decreases. This decreases the flow rate of the refrigerant gas that relieved from the crank chamber 5. As a result, the flow rate of gas relieved from the crank chamber 5 becomes smaller than the flow rate of blowby gas from the cylinder bore 1*a* (or the sum of the amount of the blowby gas and the amount of supplemental gas supplied into the crank chamber 5 via the auxiliary supply passage), thus increasing the crank pressure Pc. Under a small cooling load, the suction pressure Ps in the cylinder bore 1*a* is relatively low, and the difference between the pressure in the cylinder bore 1*a* and the crank pressure Pc increases. This decreases the inclination angle of the swash plate 12, thus decreasing the displacement of the compressor.

Even when the current is supplied to the coil 76, the internal circulation of refrigerant gas in the compressor continues. In this case, however, the discharge capacity of the compressor becomes large to some degree and the supply-side valve V2 is substantially closed, so that the blowby gas plays an important role. That is, gas circulates along the path that includes the suction chamber 21, the cylinder bore 1*a*, the crank chamber 5, the upstream portion 27*a* of the bleed passage 27, the relief-side valve V1 (via the clearance between the valve body 61 and the valve seat 55), the downstream portion 27*b* of the bleed passage 27 and the suction chamber 21. Therefore, gas flows inside the compressor, thus ensuring the feeding of the lubrication oil mist.

The controller C stops supplying the current to the coil 76 when, for example, the temperature of the evaporator 43 approaches the frost-generating temperature, when the activation switch 47 of the air-conditioning system is off or when a displacement limiting control is selected. In the displacement limiting control, when the load on a vehicle engine E increases, for example, when a vehicle is abruptly accelerated, the controller C stops supplying the current to the coil 76 to limit the displacement. This causes the electromagnetic force F of the solenoid V3 to vanish. Consequently, the actuation rod 80 is immediately moved to the lowest position (the initial position) by the force of the return spring 75, thus closing the relief-side valve V1 and opening the supply-side valve V2. As a result, a large amount of refrigerant gas flows into the crank chamber 5 from the discharge chamber 22 via the supply passage 28, which raises the crank pressure Pc. Then, the swash plate 12 is set to the minimum inclination, which minimizes the displacement of the compressor. A similar operation takes place when the engine E stalls suddenly, which blocks the current supply to the air-conditioning system.

TABLE 1 below shows the operational characteristics of the above-described control valve 50.

| Solenoid V3 | Supply-side valve V2 | Relief-side valve V1 | |
|---|---|---|---|
| | | Passage formed by the clearance between the valve body and valve seat | Passage formed inside the valve body |
| When no current is supplied | Open | Closed | Restricted passage for internal circulation is formed |
| When current is supplied | Closed (auxiliary supply passage is formed) | The opening size of the valve is adjusted according to Ps | Closed |

This embodiment has the following advantages.

The cooperation of the relief-side valve V1 and the supply-side valve V2 through the actuation rod 80 allows the control valve 50 to selectively serve as a relief-side control valve or an supply-side control valve. This overcomes the drawbacks of a single relief-side control valve or a single supply-side control valve and provides the advantages of both types of a control valves.

The crank pressure Pc is applied to the relief-side valve chamber 53, where the bellows 60, or the pressure sensitive member, is located, and the effective area A of the bellows 60 and the seal area B by the relief-side valve body 61 are approximately the same. Therefore, the control valve 50 serves as a variable target suction pressure type control valve, which has the control characteristics indicated by the third equation. That is, when the actuation rod 80 and the relief-side valve body 61 are coupled, the relief-side valve body 61 is automatically positioned in accordance with the suction pressure Ps without being influenced by the discharge pressure Pd or the crank pressure Pc. Further, the electromagnetic force F is adequately adjusted by the externally supplied current to change the target suction pressure Pset with high precision.

Incorporating a compressor having the control valve 50 of this embodiment into the cooling circuit of a vehicle air-conditioning system optimizes the displacement of the compressor in accordance with a change in the cooling load at the evaporator 43. Further, the temperature of the passenger compartment can always be kept near the desired temperature by keeping the pressure in the vicinity of the outlet of the evaporator 43, which is nearly equal to the suction pressure Ps, at or near a desired value (the target suction pressure Pset).

The relief-side valve body 61 operates in accordance only with a change ΔPs in the suction pressure Ps without being influenced by the differential pressure (Pc−Ps) or the crank pressure Pc (see the third equation). Therefore, no problems will arise even if the seal area B of the relief-side valve body 61 is increased. That is, the relief-side valve body 61 operates in response to the suction pressure Ps regardless of the level of the differential pressure (Pc−Ps) or the crank pressure Pc. As the relief-side valve body 61 displaces in the axial direction in fine response to a change ΔPs in the suction pressure Ps, therefore, the flow rate of the gas that passes between the valve body 61 and the valve seat 55 changes significantly. This significantly improves the Pc/Ps ratio of the relief-side valve V1 of the control valve 50, making it possible to control the displacement of the compressor quickly and precisely in accordance with a change in the thermal load (or the cooling load). It is therefore possible to limit or avoid hunting.

Even when the compressor is operated with the minimum displacement, a circulation passage is formed for the refrigerant gas through the relief-side valve body 61. This maintains lubrication of the individual sliding parts of the compressor. The control valve 50 is therefore most suitable for use in a clutchless compressor that is directly coupled to the drive source.

The outside diameter of the valve body 85 of the actuation rod 80 is smaller than the inside diameter of the guide passage 52 (i.e., d1−Δd1). This allows the clearance between the circumferential surface of the valve body 85 and the inner surface of the guide passage 52 (circumferential clearance) to serve as an auxiliary supply passage. Even if the displacement of the compressor is relatively small and blowby gas becomes insufficient, gas is supplied to the crank chamber 5 via the auxiliary supply passage so that the crank pressure Pc can be increased promptly when performing relief-side control.

This invention may be alternatively embodied as follows.

Figure 6:
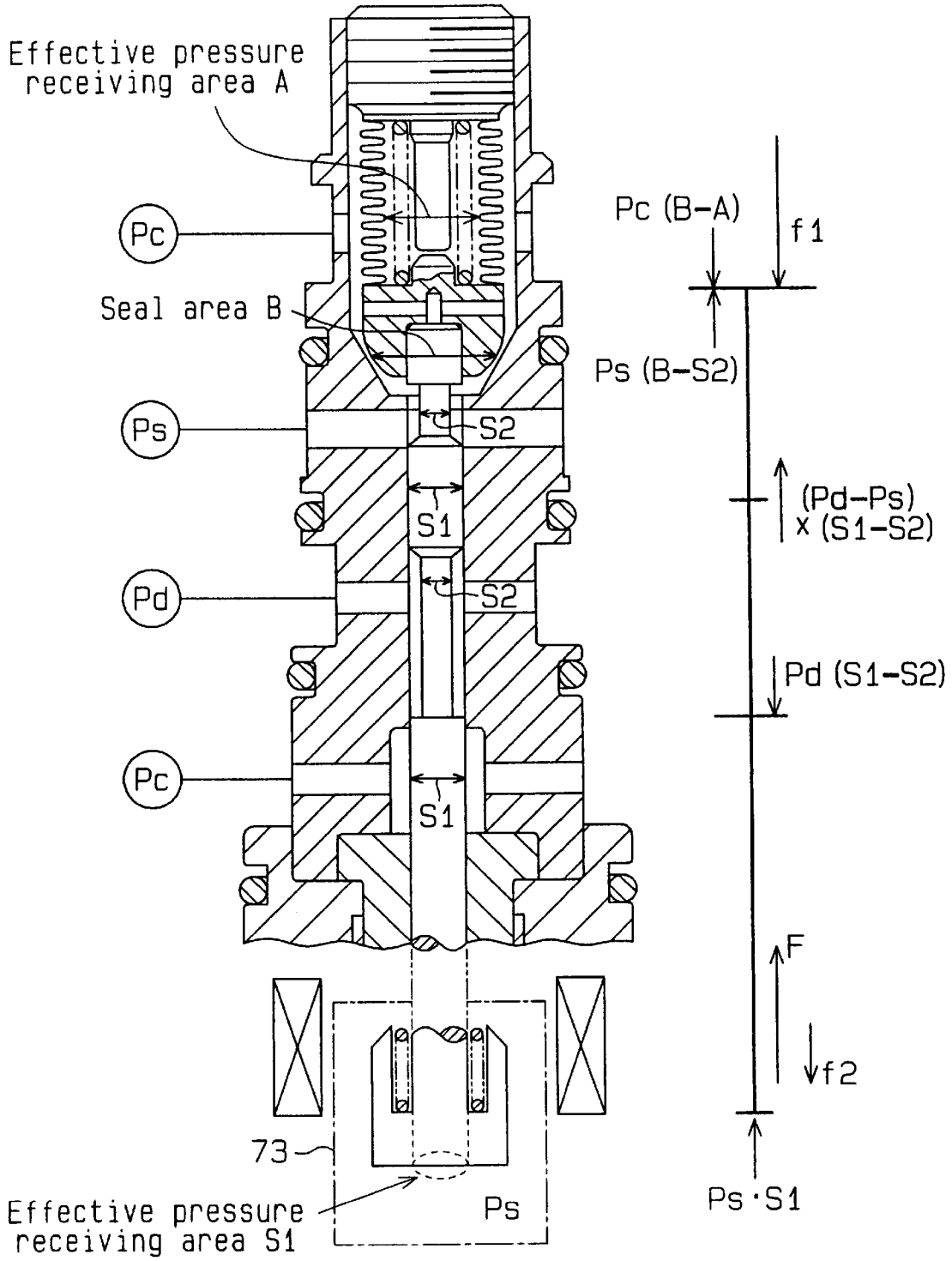
FIG. 6 is a force diagram like FIG. 5 according to a second embodiment.
Figure 7:
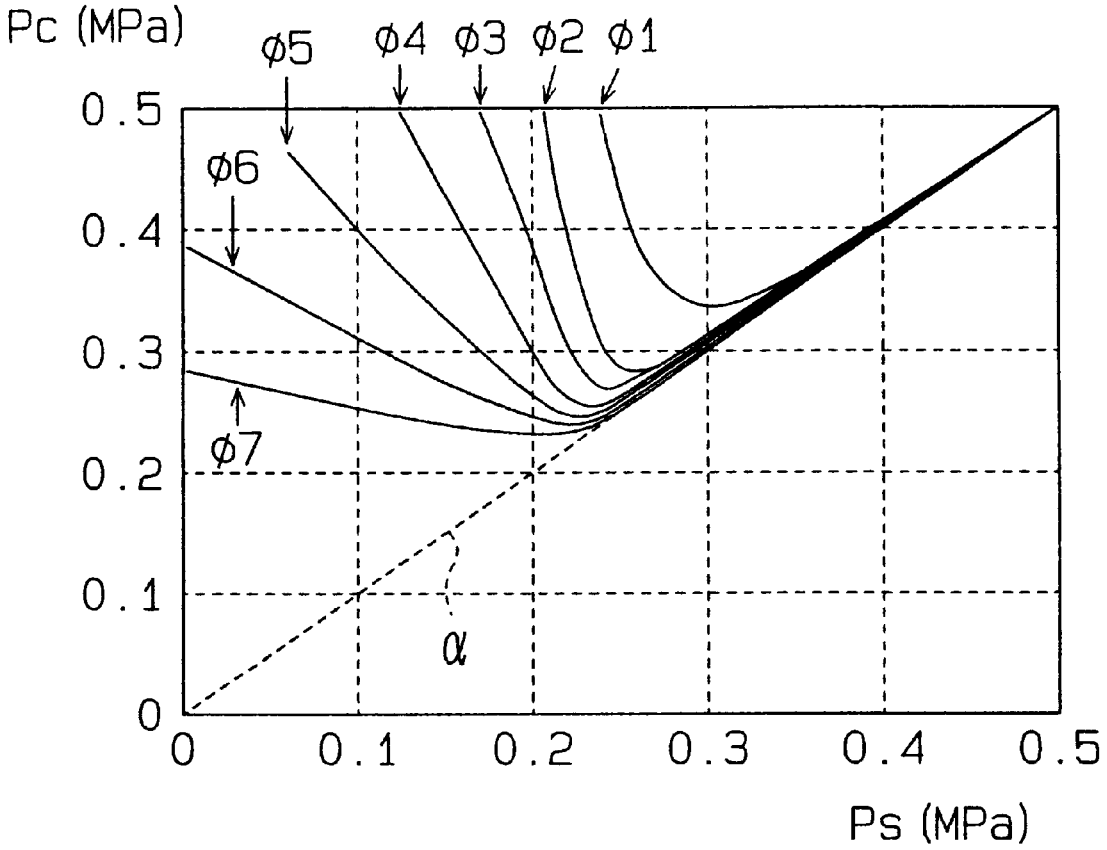
FIG. 7 is a graph illustrating the relationship between the crank pressure and the suction pressure for various valves.

The pressure supplied to the solenoid chamber 73 is not limited to the crank pressure Pc, but may be the suction pressure Ps. If the suction pressure Ps is supplied to the solenoid chamber 73, a variable target suction pressure type control valve can be constructed with area conditions simpler and less restricted than those of the embodiment illustrated in FIGS. 1 to 5. FIG. 6 shows a control valve according to a second embodiment. From the structure of the control valve in FIG. 6, a forth equation (corresponding to the first equation) is satisfied and rearranging the forth equation yields a fifth equation (corresponding to the second equation) below.

$$f1+Pc(B-A)-Ps(B-S2)-(Pd-Ps)(S1-S2)+Pd(S1-S2)-Pc\cdot S1-F+f20$$

$$Pc(B-A)-Ps\cdot B=F-f1-f2$$

The fifth equation does not contain Pd, S1 and S2. That is, the operation of the control valve in FIG. 6 is not affected by the discharge pressure Pd and the cross-sectional areas S1 and S2 of the individual members of the actuation rod 80 at all. When the effective area A of the bellows 60 and the seal area B by the valve body 61 satisfy the condition A=B, the term Pc(B−A) in the fifth equation becomes zero. If A=B, the sixth equation (corresponding to the third equation) is derived as follows.

$$Ps=(f1+f2-F)/B$$

In the sixth equation, f1, f2 and B are predetermined in the designing steps. The electromagnetic force F is a function of the value I of the current supplied to the coil 76. Like the control valve in FIG. 5, therefore, the control valve in FIG. 6 serves as a variable target suction pressure type control valve that performs control based on the externally supplied current. If the suction pressure Ps is applied to the solenoid chamber 73 so that the suction pressure Ps acts on the lower end of the actuation rod 80 as shown in FIG. 6, A can be set equal to B. This eliminates the influence of the size relationship between the seal area B and the effective pressure receiving area S1.

In the relief-side valve V1 of each of the control valves 50 shown in FIGS. 2 to 5 and FIG. 6, the bellows 60 may be replaced with a diaphragm to serve as the pressure sensitive member.

This invention may be adapted to a wobble type swash plate compressor.

It should be apparent to those skilled in the art that the present invention may be embodied in many other specific forms without departing from the spirit or scope of the invention. Particularly, it should be understood that the invention may be embodied in the following forms.

Therefore, the present examples and embodiments are to be considered as illustrative and not restrictive and the invention is not to be limited to the details given herein, but may be modified within the scope and equivalence of the appended claims.

What is claimed is:

1. A control valve for controlling the displacement of a variable displacement type compressor, wherein the compressor includes a crank chamber, a suction pressure zone, the pressure of which is suction pressure, a discharge pressure zone, the pressure of which is discharge pressure, a bleed passage for releasing gas from the crank chamber to the suction pressure zone, and a supply passage for supplying gas from the discharge pressure zone to the crank chamber, the control valve comprising:

a valve housing;

a supply side valve for controlling the opening degree of the supply passage;

a transmission rod extending in the valve housing, wherein the transmission rod moves axially and has a distal end portion and a proximal end portion;

a relief side valve for controlling the opening degree of the bleed passage, wherein the transmission rod connects the relief side valve with the supply valve, the relief side valve including:

a passage chamber constituting part of the bleed passage;

a valve seat for defining part of the passage chamber; and a relief side valve body that contacts the valve seat, the relief side valve body being located in the passage chamber, wherein, when the relief side valve body contacts the valve seat, the passage chamber is separated into a first area, which is connected to the crank chamber via an upstream part of the bleed passage, and a second area, which is connected to the suction pressure zone via a downstream part of the bleed passage; and a pressure sensing member located in the first area and moving the relief side valve body in accordance with the pressure in the first area, wherein, when the relief side valve body contacts the valve seat, the effective pressure receiving area of the pressure sensing member is substantially equal to the cross sectional area of the passage chamber that is sealed by the relief side valve body.

2. The control valve according to claim 1, wherein the distal end portion is located in the second area, wherein the control valve further includes a solenoid to urge the transmission rod in a direction to move the relief side valve body away from the valve seat with a force in accordance with an external signal.

3. The control valve according to claim 2, wherein an inner passage is formed in the relief side valve body, wherein, when the relief side valve body contacts the valve seat, a through passage is defined in the relief side valve body, wherein the through passage includes the inner passage and permits gas flow from the crank chamber to the suction pressure zone.

4. The control valve according to claim 3, wherein the valve housing has a port for receiving the distal end portion of the transmission rod, wherein, when the distal end portion enters the port, a clearance, is defined between the distal end portion and a wall defining the port.

5. The control valve according to claim 2, wherein the distal end portion of the transmission rod is located in the relief side valve, wherein the proximal end portion of the transmission rod is located in the solenoid, wherein the supply side valve is located between the relief side valve and the solenoid, wherein the relief side valve includes a guide passage that forms part of the supply passage, the transmission rod extending through the guide passage, wherein the transmission rod has a supply side valve body, and the solenoid axially moves the transmission rod such that the supply side valve body regulates an opening degree of the guide passage.

6. The control valve according to claim 5, wherein, when electric current is supplied to the solenoid, the supply side valve body restricts the guide passage, and the solenoid applies a force to the relief side valve body through the transmission rod, wherein the force corresponds to the level of a current supplied to the solenoid, and the level of the current determines a target value of the suction pressure, and wherein the pressure sensing member moves the relief side valve body such that the suction pressure is steered toward the target value.

7. The control valve according to claim 6 further includes an urging member, wherein the urging member urges the transmission rod in a direction opposite to the direction of the force applied to the transmission rod by the solenoid, wherein, when no current is supplied to the solenoid, the urging member moves the transmission rod such that the supply side valve body fully opens the guide passage and such that the relief side valve body contacts the valve seat.

8. The control valve according to claim 2, wherein the pressure in the crank chamber is applied to an area in which the proximal end portion of the transmission rod is accommodated.

9. The control valve according to claim 2, wherein the suction pressure is applied to an area in which the proximal end portion of the transmission rod is accommodated.

10. A control valve for controlling the displacement of a variable displacement type compressor, wherein the compressor includes a crank chamber, a suction pressure zone, the pressure of which is suction pressure, a discharge pressure zone, the pressure of which is discharge pressure, a bleed passage for releasing gas from the crank chamber to the suction pressure zone, and a supply passage for supplying gas from the discharge pressure zone to the crank chamber, the control valve comprising:

a valve housing;

a supply side valve for controlling the opening degree of the supply passage;

a transmission rod extending in the valve housing, wherein the transmission rod moves axially and has a distal end portion and a proximal end portion;

a relief side valve for controlling the opening degree of the bleed passage, wherein the transmission rod connects the relief side valve with the supply side valve, the relief side valve including:

a passage chamber constituting part of the bleed passage;

a valve seat for defining part of the passage chamber; and a relief side valve body that contacts the valve seat, the relief side valve body being located in the passage chamber, wherein, when the relief side valve body contacts the valve seat, the passage chamber is separated into a first area, which is connected to the crank chamber via an upstream part of the bleed passage, and a second area, which is connected to the suction pressure zone via a downstream part of the bleed passage, wherein the distal end portion of the transmission rod is accommodated in the second area;

a solenoid for urging the transmission rod in a direction to move the relief side valve body away from the valve seat with a force in accordance with an external signal, wherein the solenoid has an area for accommodating the proximal end portion, and wherein the pressure in the crank chamber is applied to the area; and a pressure sensing member located in the first area and moving the relief side valve body in accordance with the pressure in the first area, wherein the cross sectional area of the passage chamber that is sealed by the relief side valve body is substantially equal to a sum of the effective pressure receiving area of the pressure sensing member and an effective pressure receiving area of the proximal end portion.

11. A control valve for controlling the displacement of a variable displacement type compressor, wherein the compressor includes a crank chamber, a suction pressure zone, the pressure of which is suction pressure, a discharge pressure zone, the pressure of which is discharge pressure, a bleed passage for releasing gas from the crank chamber to the suction pressure zone, and a supply passage for supplying gas from the discharge pressure zone to the crank chamber, the control valve comprising:

a valve housing;

a transmission rod extending in the valve housing, wherein the transmission rod moves axially and has a distal end portion and a proximal end portion;

a solenoid located nearby in the proximal end portion of the transmission rod, wherein the solenoid urges the transmission rod in axial direction with a force in accordance with the electric current supplied to the solenoid, wherein the solenoid has an area for accommodating the proximal end portion, and wherein the pressure in the crank chamber is applied to the area;

a supply side valve for controlling the opening degree of the supply passage, wherein the supply side valve includes a guide passage that constitutes a part of the supply passage and a supply side valve body formed on the transmission rod to enter in the guide passage, wherein the solenoid moves the transmission rod such that the supply side valve body is selectively entered and moved away to the guide passage;

a relief side valve for controlling the opening degree of the bleed passage, wherein the transmission rod connects the relief side valve portion with the supply side valve portion, the relief side valve portion including:

a passage chamber constituting part of the bleed passage;

a valve seat for defining part of the passage chamber; and a relief side valve body that contacts the valve seat, the relief side valve body being located in the passage chamber, wherein, when the relief side valve body contacts the valve seat, the passage chamber is separated into a first area, which is connected to the crank chamber via an upstream part of the bleed passage, and a second area, which is connected to the suction pressure zone via a downstream part of the bleed passage; and a pressure sensing member located in the first area and moving the relief side valve body in accordance with the pressure in the first area, wherein the cross sectional area of the passage chamber that is sealed by the relief side valve body is substantially equal to a sum of the effective pressure receiving area of the pressure sensing member and an effective pressure receiving area of the proximal end portion.

12. The control valve according to claim 11, wherein an inner passage is formed in the relief side valve body, wherein, when the relief side valve body contacts the valve seat, a through passage is defined in the relief side valve body, wherein the through passage includes the inner passage and permits gas flow from the crank chamber to the suction pressure zone.

13. The control valve according to claim 12, wherein the valve housing has a port for receiving the distal end portion of the transmission rod, wherein, when the distal end portion enters the port, a clearance is defined between the distal end portion and a wall defining the port.

14. The control valve according to claim 11, wherein the distal end portion of the transmission rod is located in the relief side valve, wherein the supply side valve is located between the relief side valve and the solenoid.

15. The control valve according to claim 14, wherein, when electric current is supplied to the solenoid, the supply side valve body restricts the guide passage, and the solenoid applies a force to the relief side valve body through the transmission rod, wherein the force corresponds to the level of a current supplied to the solenoid, and the level of the current determines a target value of the suction pressure, and wherein the pressure sensing member moves the relief side valve body such that the suction pressure is steered toward the target value.

16. The control valve according to claim 15 further includes an urging member, wherein the urging member urges the transmission rod in a direction opposite to the direction of the force applied to the transmission rod by the solenoid, wherein, when no current is supplied to the solenoid, the urging member moves the transmission rod such that the supply side valve body fully opens the guide passage and such that the relief side valve body contacts the valve seat.

* * * * *